US006362711B1

(12) United States Patent
Larranaga et al.

(10) Patent No.: US 6,362,711 B1
(45) Date of Patent: Mar. 26, 2002

(54) CIRCUIT BREAKER COVER WITH SCREW LOCATING FEATURE

(75) Inventors: Javier Ignacio Larranaga, Bristol; Joseph Criniti, New Britain; Thomas Randolph Campbell, Washington, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/709,212

(22) Filed: Nov. 10, 2000

(51) Int. Cl.[7] ..... H01H 13/04

(52) U.S. Cl. ..... 335/202; 335/17; 335/42; 335/45

(58) Field of Search ..... 335/23–25, 35, 335/38, 42, 45, 176; 337/82, 94

(56) References Cited

U.S. PATENT DOCUMENTS

| | | | | |
|---|---|---|---|---|
| 2,340,682 A | | 2/1944 | Powell | |
| 2,719,203 A | | 9/1955 | Gelzheiser et al. | |
| 2,937,254 A | | 5/1960 | Ericson | |
| 3,158,717 A | | 11/1964 | Jencks et al. | |
| 3,162,739 A | | 12/1964 | Klein et al. | |
| 3,197,582 A | | 7/1965 | Norden | |
| 3,222,475 A | * | 12/1965 | Woods et al. | 335/202 |
| 3,249,720 A | * | 5/1966 | Gryctko et al. | 335/35 |
| 3,307,002 A | | 2/1967 | Cooper | |
| 3,517,356 A | | 6/1970 | Hanafusa | |
| 3,631,369 A | | 12/1971 | Menocal | |
| 3,803,455 A | | 4/1974 | Willard | |
| 3,883,781 A | | 5/1975 | Cotton | |
| 4,129,762 A | | 12/1978 | Bruchet | |
| 4,144,513 A | | 3/1979 | Shafer et al. | |
| 4,158,119 A | | 6/1979 | Krakik | |
| 4,165,453 A | | 8/1979 | Hennemann | |
| 4,166,988 A | | 9/1979 | Ciarcia et al. | |
| 4,220,934 A | | 9/1980 | Wafer et al. | |
| 4,255,732 A | | 3/1981 | Wafer et al. | |
| 4,259,651 A | | 3/1981 | Yamat | |
| 4,263,492 A | | 4/1981 | Maier et al. | |
| 4,276,527 A | | 6/1981 | Gerbert-Gaillard et al. | |
| 4,297,663 A | | 10/1981 | Seymour et al. | |
| 4,301,342 A | | 11/1981 | Castonguay et al. | |
| 4,360,852 A | | 11/1982 | Gilmore | |
| 4,368,444 A | | 1/1983 | Preuss et al. | |
| 4,375,021 A | | 2/1983 | Pardini et al. | |
| 4,375,022 A | | 2/1983 | Daussin et al. | |
| 4,376,270 A | | 3/1983 | Staffen | |
| 4,383,146 A | | 5/1983 | Bur | |
| 4,392,036 A | | 7/1983 | Troebel et al. | |
| 4,393,283 A | | 7/1983 | Masuda | |
| 4,401,872 A | | 8/1983 | Boichot-Castagne et al. | |
| 4,409,573 A | | 10/1983 | DiMarco et al. | |
| 4,435,690 A | | 3/1984 | Link et al. | |
| 4,467,297 A | | 8/1984 | Boichot-Castagne et al. | |

(List continued on next page.)

FOREIGN PATENT DOCUMENTS

| | | |
|---|---|---|
| BE | 897 691 A | 1/1984 |
| DE | 12 27 978 | 11/1966 |
| DE | 30 47 360 | 6/1982 |

(List continued on next page.)

*Primary Examiner*—Lincoln Donovan
(74) *Attorney, Agent, or Firm*—Cantor Colburn LLP; Carl B. Horton

(57) ABSTRACT

A molded circuit breaker cover for providing access to a calibration screw of a thermal trip unit is disclosed. The cover includes an exterior surface having an opening disposed therein and a locator extending from an underside of the cover. The locator includes a channel surface defining a channel continuous with the opening wherein the locator captures the calibration screw and aligns the calibration screw with the opening. Locator significantly increase the calibration yield of multi-pole circuit breakers by decreasing misalignment of the calibration screws during assembly of the circuit breaker.

27 Claims, 8 Drawing Sheets

U.S. PATENT DOCUMENTS 4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,513,268 A * 4/1985 Seymour et al. ..... 335/35
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al.
4,884,047 A 11/1989 Baginski et al.
4,884,164 A 11/1989 Dziura et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolonegeat-Mobleu et al.
4,951,019 A 8/1990 Gula
4,952,897 A 8/1990 Barnel et al.
4,958,135 A 9/1990 Bagniski et al.
4,965,543 A 10/1990 Batteux
4,983,788 A 1/1991 Pardini
5,001,313 A 3/1991 Leclerq et al.
5,004,878 A 4/1991 Seymour et al.
5,029,301 A 7/1991 Nebon et al.
5,030,804 A 7/1991 Abri
5,057,655 A 10/1991 Kersusan et al.
5,077,627 A 12/1991 Fraisse
5,083,081 A 1/1992 Barrault et al.
5,095,183 A 3/1992 Raphard et al.
5,103,198 A 4/1992 Morel et al.
5,115,371 A 5/1992 Tripodi
5,120,921 A 6/1992 DeMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 2/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A 11/1993 Livesey et al.
5,262,744 A 11/1993 Arnold et al.
5,280,144 A 1/1994 Bologeat-Mobleu et al.
5,281,776 A 1/1994 Morel et al.
5,294,902 A * 3/1994 Pannenborg et al. ..... 335/35
5,296,660 A 3/1994 Morel et al.
5,296,664 A 3/1994 Crookston et al.
5,298,874 A 3/1994 Morel et al.
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,424,701 A 6/1995 Castonguary et al.
5,438,176 A 8/1995 Bomardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
D367,265 S 2/1996 Yamagata et al.
5,493,083 A 2/1996 Olivier
5,504,284 A 4/1996 Lazareth et al.
5,504,290 A 4/1996 Baginski et al.
5,510,761 A 4/1996 Boder et al.
5,512,720 A 4/1996 Coudert et al.
5,515,018 A 5/1996 DeMarco et al.
5,519,561 A 5/1996 Mrenna et al.
5,534,674 A 7/1996 Steffens
5,534,832 A 7/1996 Duchemin et al.
5,534,835 A 7/1996 McColloch et al.
5,534,840 A 7/1996 Cuingnet
5,539,168 A 7/1996 Linzenich
5,543,595 A 8/1996 Mader et al.
5,552,755 A 9/1996 Fello et al.
5,581,219 A 12/1996 Nozawa et al.
5,604,656 A 2/1997 Derrick et al.
5,608,367 A 3/1997 Zoller et al.
5,784,233 A 7/1998 Bastard et al.

FOREIGN PATENT DOCUMENTS

DE 38 02 184 8/1989
DE 38 43 277 6/1990

| | | |
|---|---|---|
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 239 460 | 9/1987 |
| EP | 0 255 479 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

CIRCUIT BREAKER COVER WITH SCREW LOCATING FEATURE

BACKGROUND OF THE INVENTION

This invention relates to circuit breaker assemblies with a thermal trip unit and, more particularly, to circuit breakers with an adjustable thermal trip unit.

Circuit breakers typically provide protection against persistent overcurrent conditions. This type of protection is provided in many circuit breakers by a thermal trip unit, which trips the circuit breaker's operating mechanism to open the circuit breaker's main current-carrying contacts on persistent overcurrent conditions.

Modem thermal trip units include a bimetallic strip (bimetal) that bends at a predetermined temperature. One end of the bimetal is attached, typically with a screw, to a strap that conducts current from the power source to the protected circuit. Another end of the bimetal is adjacent a trip bar. Upon the occurrence of an overcurrent condition, the bimetal bends towards the trip bar and contacts the trip bar which is mechanically linked to the operating mechanism causing the main current-carrying contacts to open and stop the flow of electrical current to a protected circuit.

It is necessary for such thermal trip units to be reliable. In addition, it is desirable that thermal trip units can be adjusted or calibrated so that the breaker can be adjusted to trip at different levels of overcurrent. Typically, after a circuit breaker is assembled, each pole of the breaker is then calibrated to trip at a predefined level by adjusting corresponding calibration screws. If the circuit breaker cannot be properly calibrated due to any misalignment of the calibration screws that occurred during assembly, the breaker must be disassembled and then reassembled. Disassembly and reassembly of the circuit breaker significantly decreases the calibration yield and increases production costs. Proper alignment of the calibration screws is particularly important in a multi-pole circuit breaker since each pole's calibration screw must be aligned. The misalignment of any one calibration screw mandates the disassembly and reassembly of the circuit breaker.

BRIEF SUMMARY OF THE INVENTION

The above discussed and other drawbacks and deficiencies are overcome or alleviated by the present invention.

In an exemplary embodiment of the invention, a molded circuit breaker cover for providing access to a calibration screw of a thermal trip unit includes an exterior surface having an opening disposed therein and a locator extending from an underside of the cover. The locator includes a channel surface defining a channel continuous with the opening wherein the locator captures the calibration screw and aligns the calibration screw with the opening.

The above discussed and other features and advantages of the present invention will be appreciated and understood by those skilled in the art from the following figures and detailed description.

BRIEF DESCRIPTION OF THE DRAWINGS

The present invention will now be described, by way of example, with reference to the following FIGURES, in which.

DETAILED DESCRIPTION OF THE INVENTION

Figure 1:
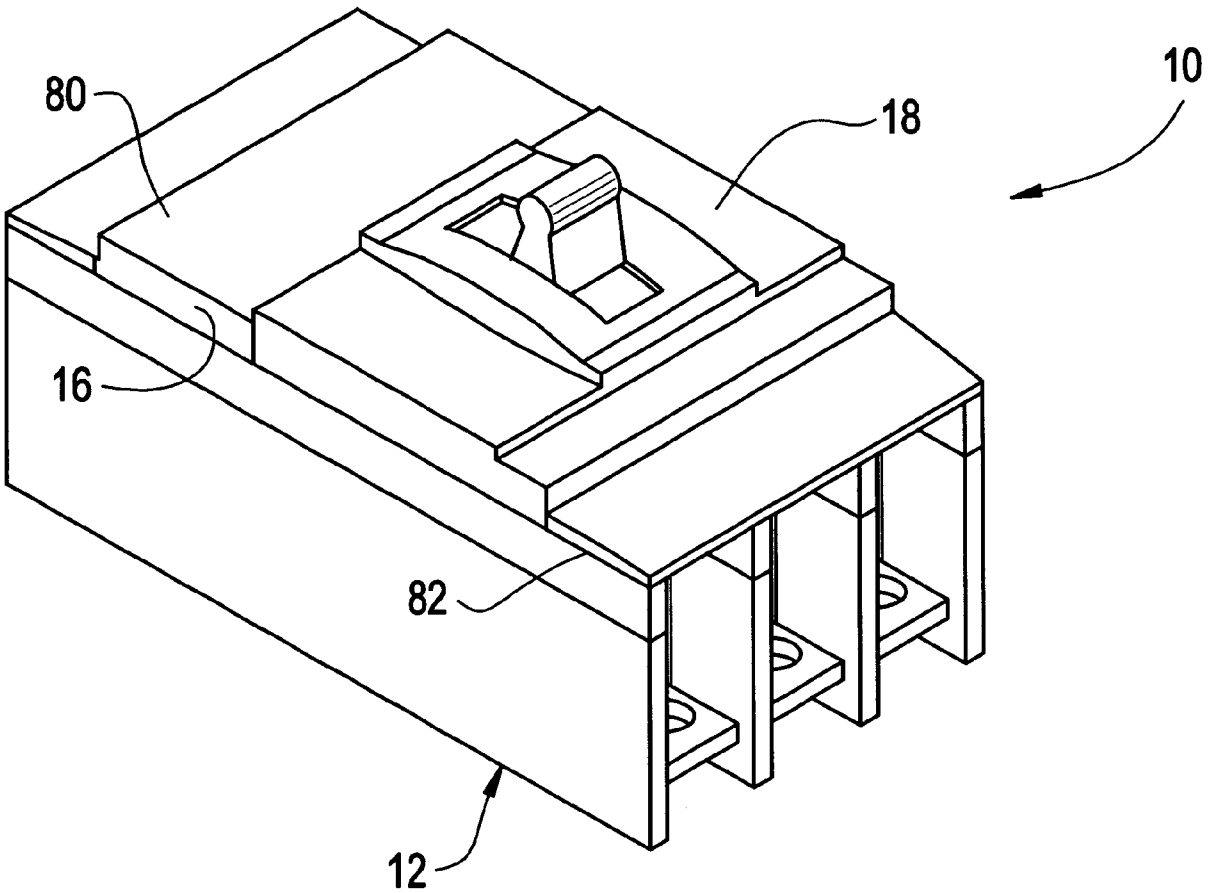
FIG. 1 PRIOR ART
FIG. 1 is a perspective view of a circuit breaker with a top cover and a mid cover.

Referring to FIG. 1, a molded case circuit breaker 10 is generally shown. Circuit breakers of this type have an insulated case shown generally at 12 that includes a mid cover 16 to house the components of the circuit breaker 10. Mid cover 16 includes a first end 80 and a second end 82. Mid cover 16 also includes an underside 74. A top cover 18 attached to the circuit breaker cover 12 protects the electronic components from the environment.

Figure 2:
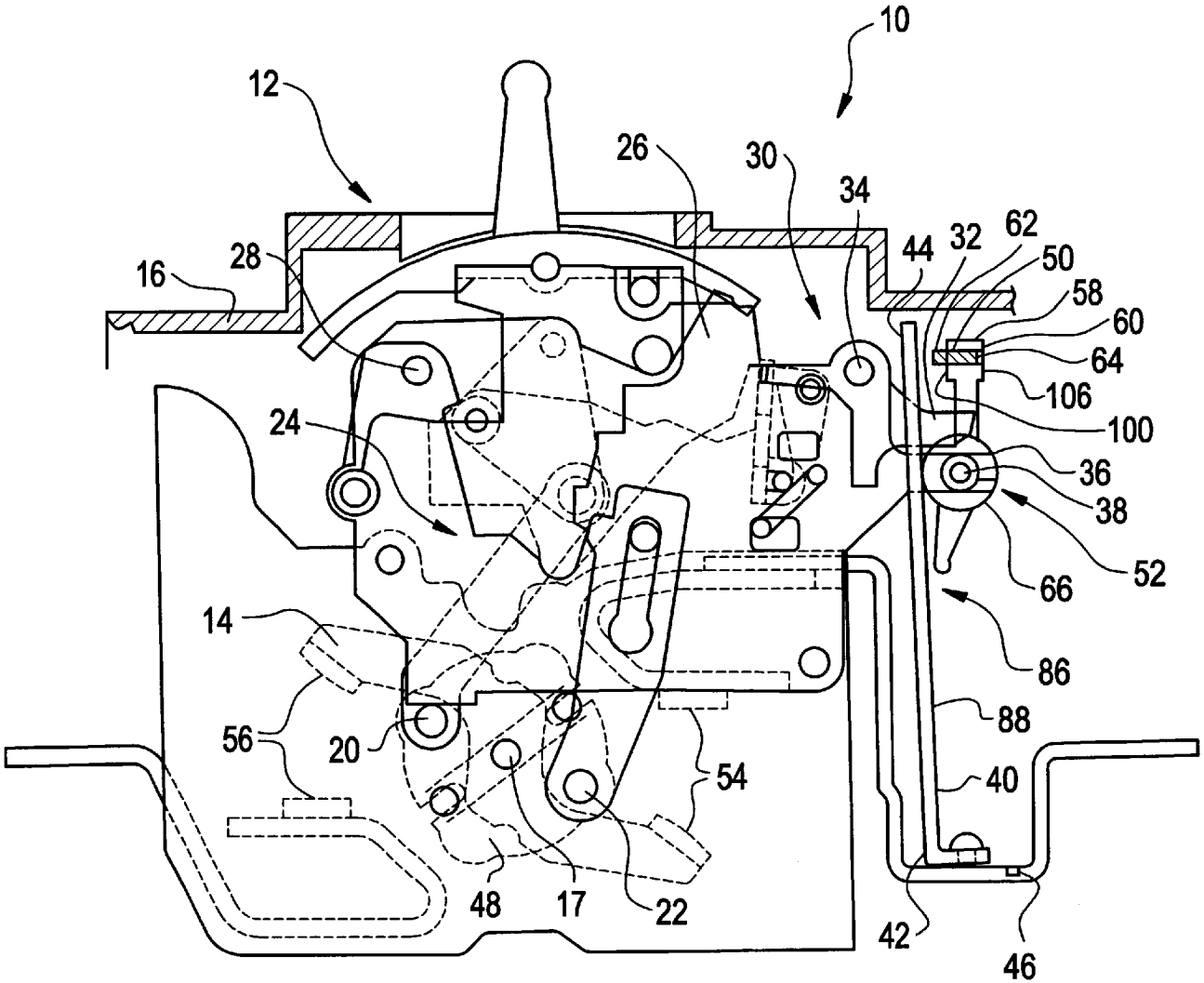
FIG. 2 is an elevation view of a circuit breaker with a thermal trip unit.

Referring to FIG. 2, the circuit breaker 10 has a rotary contact arm 14 which is mounted on an axis 17 of a rotor 48 such that contact arm 14 can rotate. The rotor 48 itself is mounted in a cassette (not shown) and has two diametrically opposed satellite axes 20, 22, which are also rotated about the axis 17 when the rotor 48 rotates. The axis 20 is the point of engagement for a linkage 24 that is connected to a latch 26. The latch 26 is mounted, such that it can pivot, on an axis 28 positioned on the case 12. In the event of an overcurrent condition, latch 26 is released by a latching mechanism 30, moving the contact arm 14 to the OPEN position as shown in FIG. 2. In the OPEN position, a first and a second pair of electrical contacts 54, 56 are open thereby preventing current flow through the circuit breaker 10.

The latching mechanism 30 can be actuated by a trip lever 32 that pivots about an axis of rotation 34. The other end of the trip lever 32 contacts an adjusting bar 52, which is rotatably mounted about a trip shaft 36. Trip shaft 36 is mounted on an axis 38 supported by the case 12.

Mounted to the circuit breaker 10 in the bottom region of the circuit breaker 10 is a thermal trip unit, shown generally at 86. Thermal trip unit 86 includes a heat sensitive strip, for example, a bimetal 40, having a first end 42, a second free end 44 and a surface 88 therebetween. First end 42 is attached to a current carrying strap 46 electrically connected to contact pair 54 of the circuit breaker 10. Any process commonly used in circuit breaker manufacturing can be used to effect the attachment of the first end 42 of bimetal 40 to the strap 46 (e.g. mechanical fasteners, brazing, welding).

Adjusting bar 52 is mechanically linked to the latching mechanism 30 through trip shaft 36. Adjusting bar 52 includes a main body portion 66, preferably cylindrical in shape, that rotates clockwise about trip shaft 36. Trip shaft 36 extends longitudinally through adjusting bar 52. Extending from main body portion 66 is an arm 58 having a screw accepting aperture 60. Arm 58 includes an end 100 located proximate to the bimetal 40 and an opposing end 106. Main body portion 66 includes a cut-out portion (not shown) that permits the adjusting bar 52 translational movement relative to the trip shaft 36.

The second end 44 of bimetal 40 is adjacent to a first free end 62 of a calibration screw 50. Calibration screw 50 also has a second free end 64. Calibration screw 50 is threadingly engaged in aperture 60 of arm 58.

Figure 3:
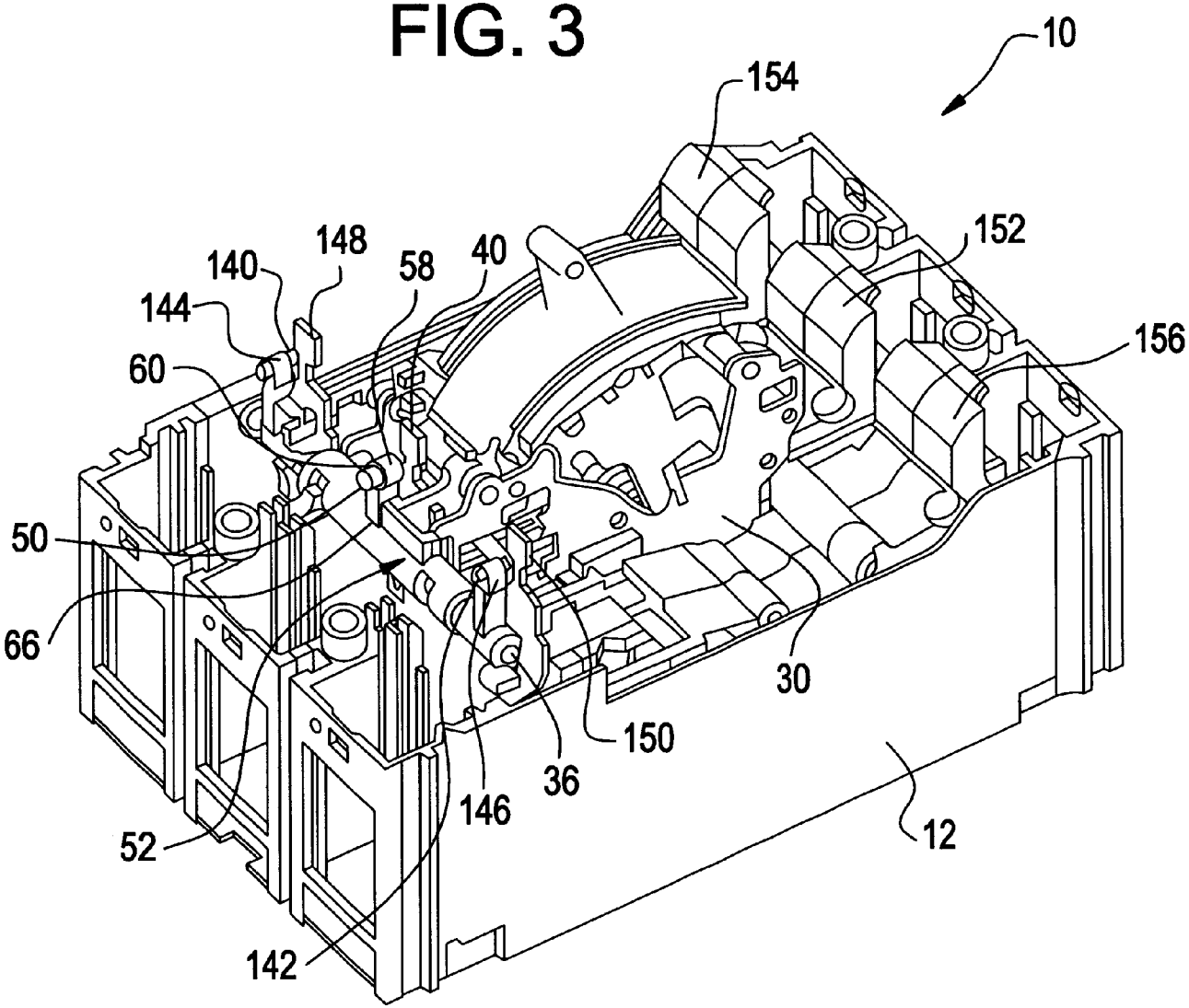
FIG. 3 is a perspective view of the circuit breaker of FIG. 1 with the top cover and the mid cover removed.

Referring to FIGS. 2 and 3, the thermal trip unit 86 operates as follows. FIG. 3 is a perspective view of the circuit breaker 10 showing the adjusting bar 52, bimetal 40 and calibration screw 50.

When an overcurrent condition occurs, strap 46 generates heat that increases the temperature of the bimetal 40. If the temperature of the bimetal 40 increases sufficiently, due to the current draw exceeding a predefined current level, the second free end 44 of the bimetal 40 deflects from an initial position thereby engaging first free end 62 of the calibration screw 50. Due to the force applied by the bimetal 40 to the first free end 62 of the calibration screw 50, adjusting bar 52 rotates in a clockwise direction rotating the trip lever 32. The rotation of the trip lever 32 unlatches the latching mechanism 30 such that it in turn can release latch 26 for a pivoting motion, upward in FIG. 1 about axis 28. This motion is caused by a spring, which is not shown in detail in FIG. 1. The motion of the linkage and the pivoting motion of latch 26 brings about a rotation of rotor 48 disconnecting the first and second contact pairs 54, 56 causing all poles of the circuit breaker 10 to trip in response to the overcurrent fault condition.

Figure 4:
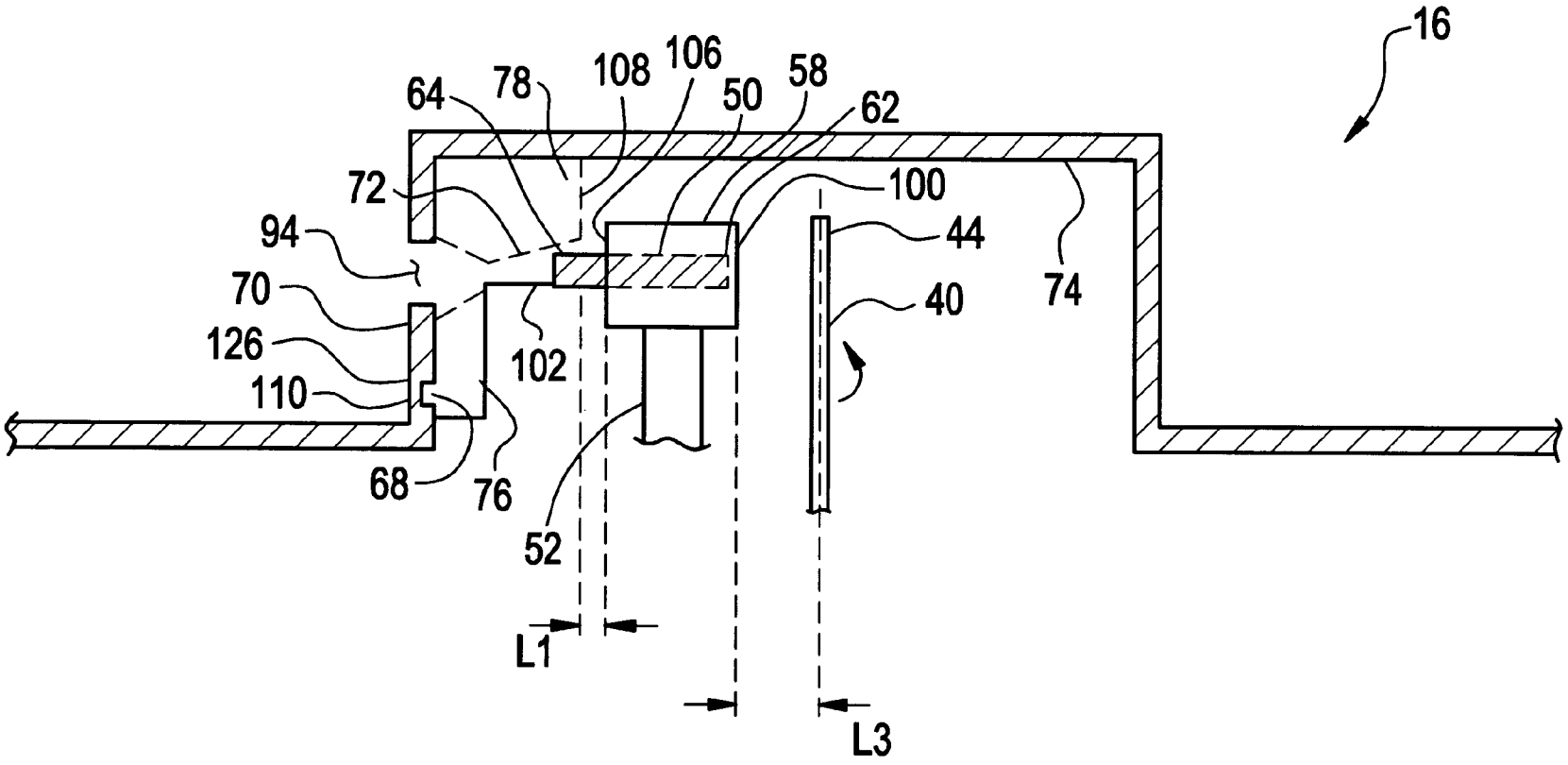
FIG. 4 is a side view of the locator and thermal trip unit within the mid cover prior to calibration.
Figure 5:
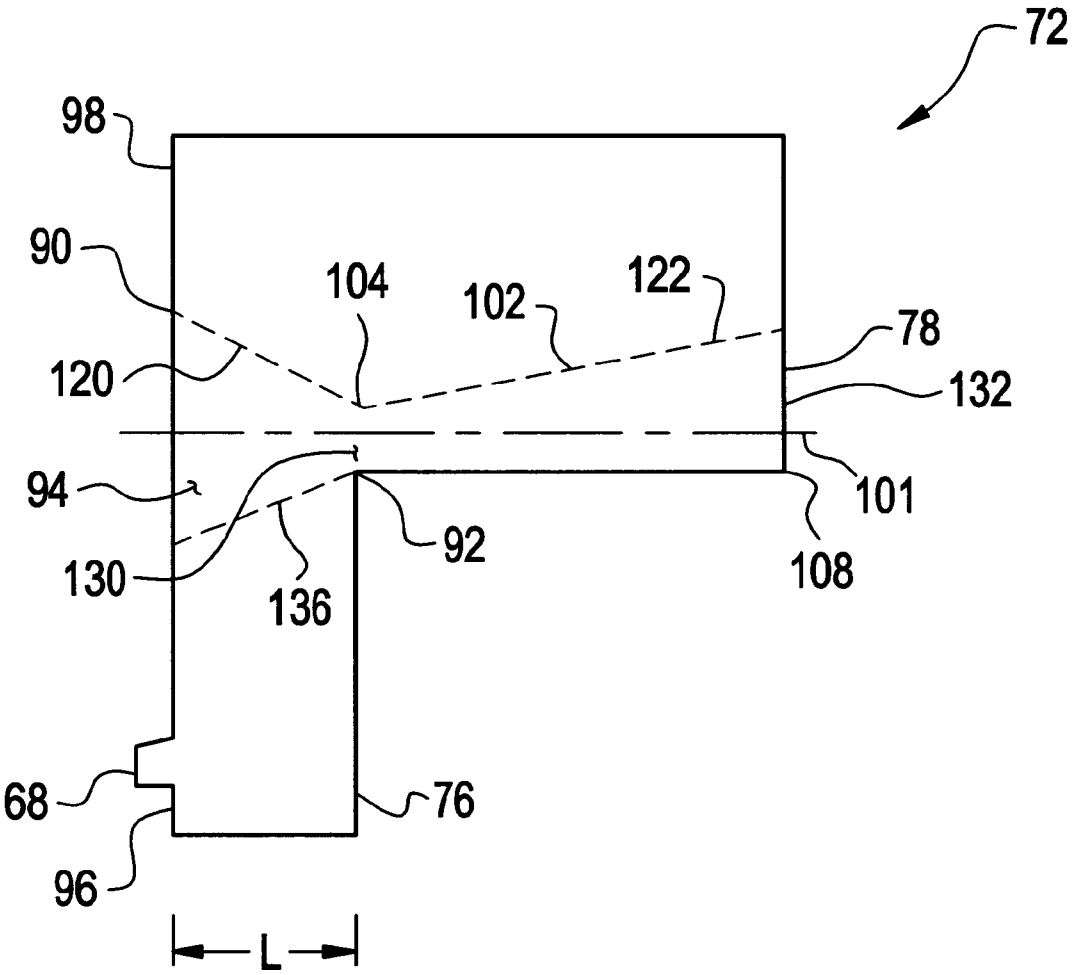
FIG. 5 is a side view of the locator.
Figure 6:
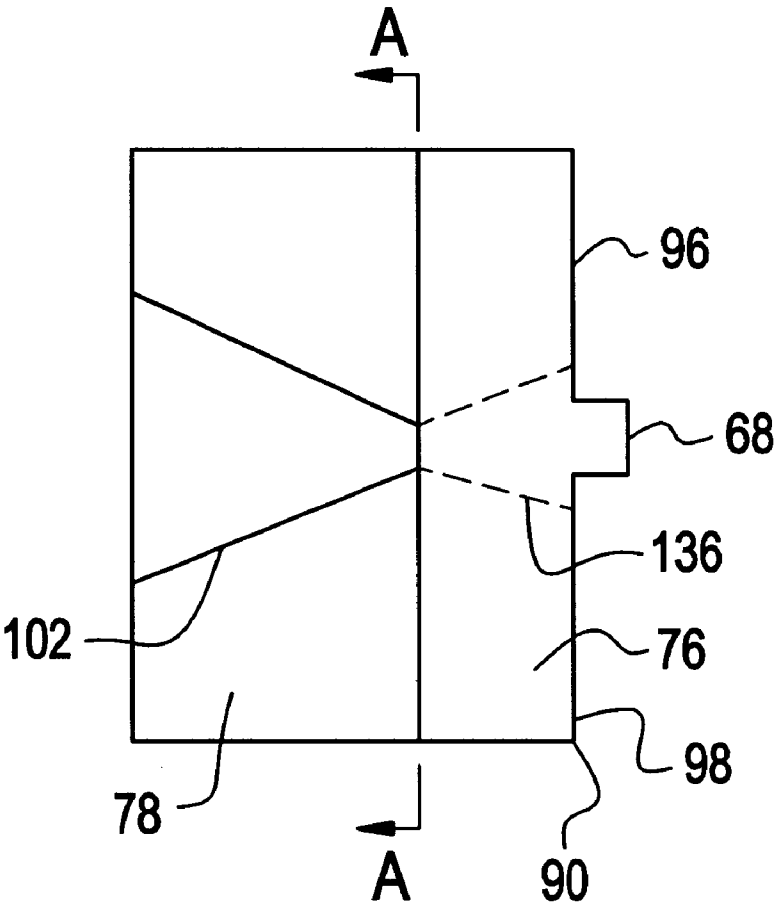
FIG. 6 is a bottom view of the locator as seen from the interior of the circuit breaker.

Referring now to FIG. 4, a portion of mid cover 16 employing a locator 72 according to the present invention is shown. Locator 72 extends from an underside 74 of mid cover 16. An exterior surface 126 of the mid cover 16 includes an opening at a first end (load side) 70 of the mid cover 16.

Referring to FIGS. 4, 5, 6 and 7, locator 72 is shown in side, bottom and sectional views, respectively. Locator 72 includes a first section 76 and a second section 78.

First section 76 of locator 72 includes a first end 90 located proximate opening 94 of the mid cover 16 and a second end 92 proximate inlet 130 of channel 102 of length L. First section 76 also includes a passage 136 having a passage surface 120, preferably conical, extending between the first end 90 and the second end 92. Passage 136 extends within the first section 76 between the first end 90 and the second end 92. Preferably, passage surface 120 of passage 136 is inclined inward at a taper angle from the first end 90 to the second end 92.

Second section 78 of locator 72 is integral with the first section 76. Second section 78 includes a first end 104 and a second end 108 and a channel 102. Channel 102 includes a surface 122, an inlet 130 proximate opening 94 and an outlet 132 opposite said inlet 130 and proximate to the second end 108. Preferably, the inlet 130 and the outlet 132 are generally perpendicular to the surface 122. An area of cross section of the outlet 132 is generally greater than an area of cross section at the inlet 130. Preferably, the surface 122 of the channel 102 is tapered inward from the outlet 132 to the inlet 130 at a taper angle where the taper angle is relative to a longitudinal axis shown at 101 through the channel 102.

The attachment of the locator 72 to the underside 74 of mid cover 16 will now be detailed. Second section 78 includes a wall 96 at the first end 90. Wall 96 further includes an edge 98 and an opposing edge 112. Edges 98 and 112 extend in a cross-wise direction along the second section 78. A tab 68 extends outward from wall 96. Tab 68 is inserted into a recess 110 located within the underside 74 thereby securely engaging the locator 72 to the underside 74 of the mid cover 16. Preferably, the tab 68 is centrally located within the wall 96 along edge 98. Most preferably, locator 72 is integrally molded within the underside 74 of the mid cover 16.

Further, the channel 102, passage 136 and the opening 94 are continuous and aligned such that the calibration tool may be inserted through the opening 94 from the exterior of the assembled circuit breaker 10 (FIG. 1) and extend through opening 94, passage 136 and into channel 102 to make contact with the second end 64 (FIG. 2) of the calibration screw 50 (FIG. 2) positioned proximate to the first end 104 of the channel 102. The channel 102 is positioned in the underside 74 of the mid cover 16 such that the outlet 132 of channel 102 faces inward toward the interior of the cassette 152 and coincides with the centerline of the calibration screw 50.

Referring to FIGS. 2, 3, 4, 5 and 6, the assembly of the circuit breaker 10 is as follows.

The adjusting bar 52 is translationally moved to one side of the case 12 along trip shaft 36 such that the arm 58 is positioned proximate surface 88 of the bimetal 40. Next, the calibration screw 50 is threadingly engaged through aperture 60 of arm 58 such that first free end 62 of the calibration screw 50 is positioned adjacent to the surface 88 of the bimetal 40. Prior to assembly of the mid cover 16, the calibration screw 50 is fully retracted from the bimetal 40.

Next, the mid cover 16 is placed over the latching mechanism 30 and thermal trip unit 86 from the top down. The mid cover 16 is secured to the case 12 by means of mechanical fasteners (not shown) inserted through apertures (not shown) in the mid cover 16 and through corresponding apertures (not shown) in the case 12. When the mid cover 16 is placed over the latching mechanism 30, the tapered surface 122 of channel 102 captures and slidingly guides the calibration screw 50 along the longitudinal axis of the trip shaft 36 to a predetermined location such that the second end 64 of the calibration screw 50 is aligned with opening 94. Also, the calibration screw 50 is of a predetermined length such that when the mid cover 16 is assembled over the latching mechanism 30, a predetermined portion of the length of the screw extends outward from the arm 58 such that it can be captured within the channel 102 located within second section 78 of locator 72. Thus, after the mid cover 16 is assembled, the centerline of the calibration screw 50 is aligned with the opening 94 thereby providing access for the calibration tool. Also, the first end 62 of the calibration screw 50 is positioned adjacent to surface 88 of the bimetal 40 in a 'ready-to-trip' position. Further, a predetermined distance L1 is provided between the second end 108 of second section 78 and end 100 of arm 58. Distance L1 provides a clearance between the adjusting bar 52 and the locator 72 in order to allow rotation of the adjusting bar 52 once the deflected bimetal 40 engages the calibration screw 50. The bimetal 40 is deflected in the direction of the arrow shown on FIG. 8.

Figure 8:
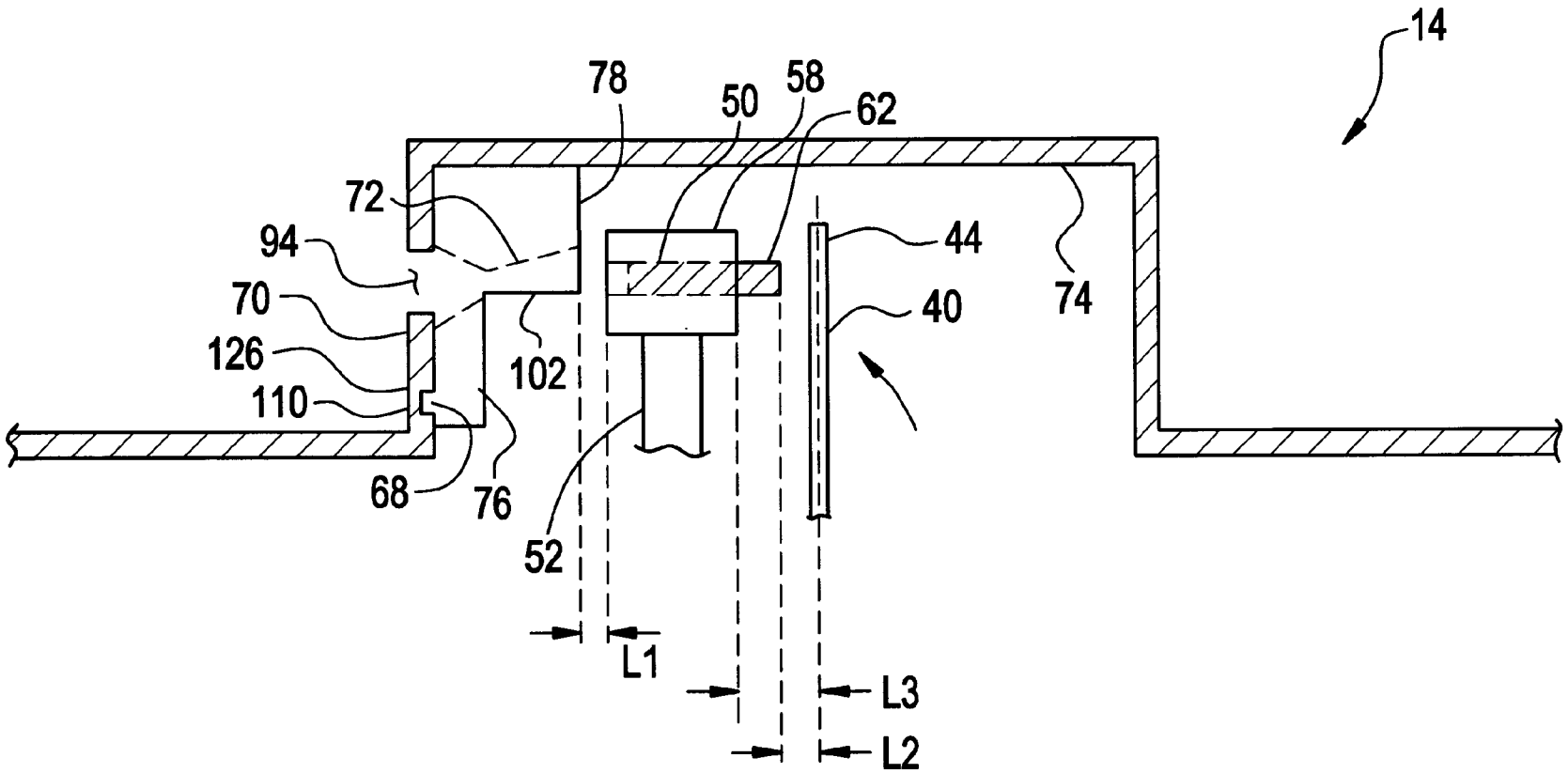
FIG. 8 is a side view of the locator and thermal trip unit within the mid cover after calibration.

The calibration of the circuit breaker 10 using the locator 72 will now be described in reference to FIGS. 2, 3, 4 and 8. FIG. 8 is a side view of the locator and thermal trip unit within the mid cover after calibration.

In an unactuated state of the bimetal 40, which is to say when the contact arm 14 is closed and an overcurrent condition is not present, the calibration screw 50 is positioned a predetermined distance L3 from the second end 44 of the bimetal 40. In this way, the distance L3 is adjusted thereby setting the current at which the thermal trip unit 86 responds to an overcurrent condition.

The calibration tool is inserted into opening 94 and engages the second end 64 of the calibration screw 50. The tool is employed to rotate the calibration screw 50 about its longitudinal axis in a first rotational direction threadingly engaging the calibration screw 50 within the threads of the aperture 60 in arm 58 of adjusting bar 52. The calibration screw 50 is threadingly engaged into the aperture 60 so that first end 62 of the calibration screw 50 makes contact with the bimetal 40. Next, the tool is used to rotate the calibration screw 50 in a second rotational direction causing the first end 62 of calibration screw 50 to be retracted from engagement with the surface 88 of the bimetal 40. The distance the calibration screw 50 is retracted corresponds to a predetermined distance L2. Predetermined distance L2 ensures that the first end 62 of the calibration screw 50 after final calibration is permitted engagement with the heated bimetal 40 as it deflects during a predetermined overcurrent condition.

The present invention thus significantly increases the calibration yield of assembled circuit breakers. The channel 102 of the locator 72 positions the mid cover 16 over the latching mechanism 30 such that the centerline of the calibration screw 50 is aligned with the opening 94 and passage 136 thereby providing access for the calibration tool. The passage 136 of second section 78 of the locator 72 also guides the calibration tool to the calibration screw 50. Thus, the locator 72 significantly increase the calibration yield of multi-pole circuit breakers by decreasing the potential for misalignment of the calibration screws 50 during assembly of the circuit breaker 10. Decreasing the potential for misalignment ensures that the calibration process can be efficiently completed.

Also, since the mid cover 16 incorporates a locator 72 for each pole of a multi-pole circuit breaker, the placement of the mid cover 16 over the latching mechanism 30 and the calibration screws 50 will move the adjusting bar 52 to a predetermined 'start' location to locate all the calibration screws 50 to a true center.

Referring to FIG. 3, it is noted that the locator 72 can be used in a multi-pole circuit breaker 10. In a multi-pole circuit breaker, the adjusting bar 52 includes calibration screws 50, 140, 142 each respectively threadingly engaged in arms 58, 144, 146. It is noted that arms 144, 146 are similarly configured as arm 58. Likewise, locator 72 can be used with each arm 144, 146 and adjusting bar 52 as described hereinabove with reference to arm 58. Calibration screws 50, 140, 142 correspond to the number of poles as shown in FIG. 3. Each calibration screw 50, 140, 142 is adjacent a corresponding bimetal 40, 148, 150. The multi-pole circuit breaker 10 includes a plurality of cassettes 152, 154, 156, with each cassette 152, 154, 156 having its own contact arm and rotor arrangements as shown in FIG. 2 for cassette 152. It is understood that one cassette is used for each phase in the electrical distribution circuit. Adjusting bar 52 extends along the row of cassettes 152, 154, 156, parallel to axis 28 of trip shaft 36.

Figure 7:
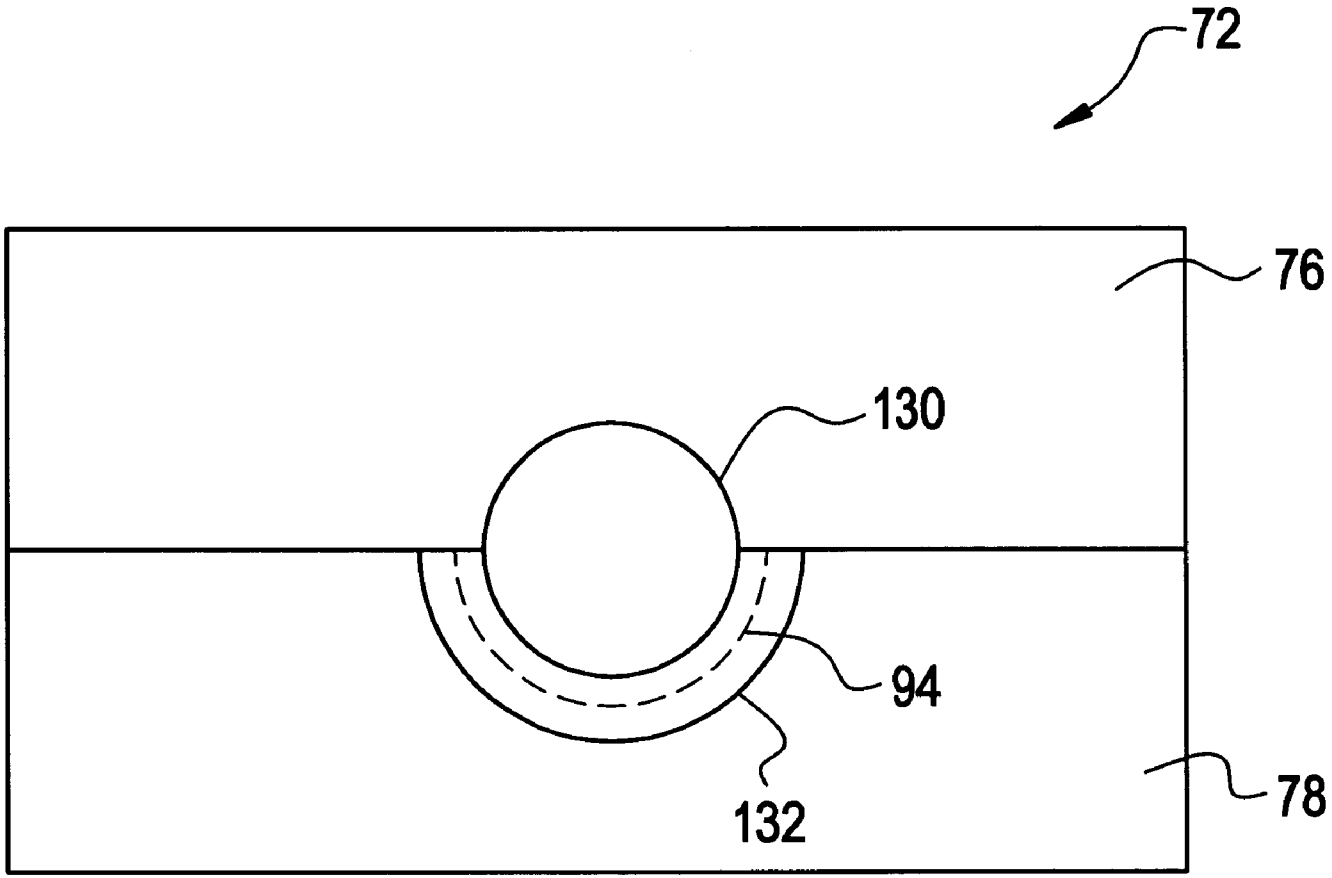
FIG. 7 is a sectional view of the locator as taken along section lines A—A of FIG. 6.

Referring to FIG. 7, the mid cover 16 includes locators 72, 158, 160 corresponding to the number of calibration screws 50, 140, 142, respectively. Upon assembly, the locators 72, 158, 160 locate the respective calibration screws 50, 140, 142 for all the poles and bring each to true center. Thus, upon individual calibration of the tripping sensitivity for each pole, the calibration screws 50, 140, 142 are easily found by the calibration tool as the respective locators 72, 158, 160 guide the tool to each of the calibration screws 50, 140, 142.

It is further noted and within the scope of this invention that the locator 72 as described can be employed on a variety of circuit breaker covers including a top cover.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments failings within the scope of the appended claims.

What is claimed is:

1. A molded circuit breaker cover for providing access to a calibration screw of a thermal trip unit, said cover comprising:

an exterior surface having an opening disposed therein;

an underside, said opening passing though said exterior surface and said underside;

a locator extending from said underside of said cover, said locator includes:

a passage surface defining a passageway, said passageway extending from said opening;

a channel surface defining a channel, said channel extending from said passageway and continuous through said locator;

wherein said locator aligns said calibration screw with said opening; and wherein said locator provides access to said calibration screw from said opening through said passageway and said channel.

2. The cover of claim 1 wherein said locator includes:a first end of said locator, said opening disposed at said first end;

a middle section of said locator, said passageway extending from said first end to said middle section;

a third end of said locator, said channel extending from said middle section to said third end; and an inlet disposed at said middle section;

an outlet disposed at said third end; and wherein said channel surface tapering from said outlet to said inlet.

3. The cover of claim 2 wherein an area of cross section of said inlet is less than an area of cross section of said outlet and said channel is continuous from said inlet to said outlet.

4. The cover of claim 3 wherein said inlet has a circular cross section.

5. The cover of claim 3 wherein said channel having a generally circular cross section and tapering from said outlet to said inlet.

6. The cover of claim 1 wherein said locator is shaped to include:

a first section having a first end and a second end;

an inlet is disposed at said first end;

an outlet is disposed at said second end;

wherein said channel extending continuously from said inlet to said outlet;

a second section including:

a third end and a fourth end, said third is aligned with said opening and said fourth end is aligned with said inlet of said channel;

wherein said passage surface defining said passageway extending interiorly thereof between said third end and said fourth end; and wherein said second section is integral with said first section and said channel is continuously aligned with said passageway to permit insertion of a tool within said passageway.

7. The cover of claim 1 wherein said passage surface is a curved surface.

8. The cover of claim 1 wherein said channel surface is a curved surface.

9. The cover of claim 6 wherein an area of cross section of said passageway at said third end is greater than an area of cross section of said passageway at said fourth end and said passageway is continuous from said opening to said inlet.

10. The cover of claim 6 wherein said passageway having a generally circular cross section and tapering from said first end to said second end.

11. The cover of claim 6 wherein an area of cross-section at any given place within said channel and said passageway being greater than the area of cross-section of said inlet of said channel.

12. The cover of claim 1 wherein said locator is integrally formed with said cover.

13. A circuit breaker comprising:

a pair of electrical contacts;

a trip unit configured to separate said pair of electrical contacts, said trip unit including:

an adjusting bar configured to interact with said trip unit, said adjusting bar includes a calibration screw threadingly engaged thereto; and a molded case having a cover, said cover includes:

an exterior surface having an opening disposed therein;

an underside, said opening passing though said exterior surface and said underside; a locator extending from said underside of said cover, said locator includes:

a passage surface defining a passageway, said passageway extending from said opening;

a channel surface defining a channel, said channel extending from said passageway and continuous through said locator;

wherein said locator aligns said calibration screw with said opening; and wherein said locator provides access to said calibration screw from said opening through said passageway and said channel.

14. The circuit breaker of claim 13 wherein said locator includes:

a first end of said locator, said opening aligned with said first end;

a middle section of said locator, said passageway extending from said first end to said middle section;

a third end of said locator, said channel extending from said middle section to said third end; and an inlet disposed at said middle section;

an outlet disposed at a third end; and;

wherein said channel surface tapering from said outlet to said inlet.

15. The circuit breaker of claim 14 wherein an area of cross section of said inlet is less than an area of cross section of said outlet and said channel is continuous from said inlet to said outlet.

16. The circuit breaker of claim 15 wherein said inlet has a circular cross section.

17. The circuit breaker of claim 15 wherein said channel having a generally circular cross section and tapering from said outlet to said inlet.

18. The circuit breaker of claim 13 wherein said locator is shaped to include:

a first section having a first end and a second end;

an inlet is disposed at said first end;

an outlet is disposed at said second end;

wherein said channel extending continuously from said inlet to said outlet;

a second section including:

a third end and a fourth end, said third is aligned with said opening and said fourth end is aligned with said inlet of said channel;

wherein said passage surface defining said passageway extending interiorly thereof between said third end and said fourth end; and wherein said second section is integral with said first section and said channel is continuously aligned with said passageway to permit insertion of a tool within said passageway.

19. The circuit breaker of claim 13 wherein said passage surface is a curved surface.

20. The circuit breaker of claim 13 wherein said channel surface is a curved surface.

21. The circuit breaker of claim 18 wherein an area of cross section of said passageway at said third end is greater than an area of cross section of said passageway at said fourth end and said passageway is continuous from said opening to said inlet.

22. The circuit breaker of claim 18 wherein said passageway having a generally circular cross section and tapering from said first end to said second end.

23. The circuit breaker of claim 18 wherein an area of cross-section at any given place within said channel and said passageway being greater than the area of cross-section of said inlet of said channel.

24. The circuit breaker of claim 13 wherein said locator is integrally formed with said cover.

25. The circuit breaker of claim 13 wherein said cover further includes a recess and said locator further includes a tab engagingly received within said recess.

26. A process of calibration for a circuit breaker having a bimetal within a case for sensing current and a trip lever which causes actuation of a latching mechanism to interrupt current flow, the process comprising:

providing an adjusting bar having an arm including an aperture for receiving and holding a calibration screw, said arm being proximate to the bimetal and having a first end and a second end;

engaging said calibration screw within said aperture;

aligning said calibration screw with an opening in the case;

inserting a tool within said aperture of said case; and calibrating said calibration screw by adjusting said calibration screw a predetermined distance from said bimetal.

27. A method of calibrating a circuit breaker with a circuit breaker cover in place on said circuit breaker, said method comprising:

inserting a calibration tool into an opening of said circuit breaker cover and into a locator;

extending said calibration tool through a passageway of said locator;

engaging said calibration tool with a first end of said calibration screw;

rotating said calibration screw with said calibration tool in a first rotational direction until a second end of said calibration screw makes contact with a bimetal; and rotating said calibration screw with said calibration tool in a second rotational direction causing second end of said calibration screw to be retracted from engagement with said bimetal, said calibration screw retracted from engagement with said bimetal a predetermined distance.

* * * * *